US009431749B2

(12) United States Patent
Mingo et al.

(10) Patent No.: US 9,431,749 B2
(45) Date of Patent: Aug. 30, 2016

(54) ELECTRICAL CONNECTOR ASSEMBLY COMPRISING AN ARRAY OF ELONGATED ELECTRICAL CONTACTS

(71) Applicant: Tyco Electronics Corporation, Berwyn, PA (US)

(72) Inventors: Tisha Mikhaili Mingo, Trenton, NJ (US); Randy Thomas Matthews, Yadkinville, NC (US); Galen M. Martin, Camp Hill, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 29 days.

(21) Appl. No.: 14/320,206

(22) Filed: Jun. 30, 2014

(65) Prior Publication Data

US 2015/0380857 A1 Dec. 31, 2015

(51) Int. Cl.

| | |
|---|---|
| ***H01R 13/44*** | (2006.01) |
| ***H01R 13/453*** | (2006.01) |
| ***H01R 13/46*** | (2006.01) |
| *H01R 13/629* | (2006.01) |

(52) U.S. Cl.

CPC ..... *H01R 13/4538* (2013.01); *H01R 13/46* (2013.01); *H01R 13/62938* (2013.01)

(58) Field of Classification Search

CPC ..... H01R 13/4538; H01R 13/447; H01R 13/631; H01R 13/62938; H01R 13/62953; H01R 13/62933; H01R 13/453

USPC ..... 439/140, 141, 157

See application file for complete search history.

(56) References Cited

U.S. PATENT DOCUMENTS

| | | | | |
|---|---|---|---|---|
| 5,269,696 | A | 12/1993 | Okada et al. | |
| 6,193,531 | B1 * | 2/2001 | Ito | H01R 13/62933 439/140 |
| 6,422,881 | B1 * | 7/2002 | Puhl | H01R 13/4538 439/140 |
| 6,623,285 | B2 * | 9/2003 | Nishide | H01R 13/4538 439/140 |
| 6,644,992 | B2 * | 11/2003 | Maegawa | H01R 13/62938 439/157 |
| 6,821,135 | B1 | 11/2004 | Martin | |
| 7,249,958 | B2 * | 7/2007 | Ishikawa | H01R 13/631 439/140 |
| 7,513,784 | B2 * | 4/2009 | Shibata | H01R 13/62938 439/157 |
| 7,588,455 | B2 | 9/2009 | Matsumura et al. | |
| 2003/0109167 | A1 | 6/2003 | Maegawa | |
| 2004/0242084 | A1 | 12/2004 | Fujita | |
| 2006/0205264 | A1 | 9/2006 | Katsuma | |
| 2011/0294311 | A1 | 12/2011 | De La Reza et al. | |

FOREIGN PATENT DOCUMENTS

| | | | |
|---|---|---|---|
| EP | 0532366 | B1 | 3/1996 |
| EP | 1 257 013 | A1 | 11/2002 |

OTHER PUBLICATIONS

International Search Report,International Application No. PCT/US2015/037936, International Filing Date, Jun. 26, 2015.

*Primary Examiner* — Hien Vu

(57) ABSTRACT

Electrical connector assembly including a connector housing having a front end and a receiving cavity that opens to the front end. The receiving cavity is configured to receive a mating connector therein that is inserted into the receiving cavity along a central axis. The electrical connector assembly also includes a contact array of electrical contacts that is disposed within the receiving cavity. The electrical contacts have elongated bodies that extend generally parallel to the central axis through the receiving cavity. The electrical connector assembly also includes a movable guard that is configured to be slidably held by the contact array within the receiving cavity. The movable guard includes a dielectric sheet that extends transverse to the central axis and has an array of thru-holes. Inner edges of the thru-holes engage corresponding electrical contacts to slidably hold the movable guard at a forward position within the receiving cavity.

20 Claims, 7 Drawing Sheets

ELECTRICAL CONNECTOR ASSEMBLY COMPRISING AN ARRAY OF ELONGATED ELECTRICAL CONTACTS

BACKGROUND

The subject matter herein relates generally to an electrical connector assembly that has an array of electrical contacts and is configured to mate with another connector having a corresponding array of electrical contacts.

Electrical connectors may be used to transfer data and/or electrical power between different systems or devices. Electrical connectors are often designed to operate in challenging environments where contaminants, shock, and/or vibration can disrupt the electrical connection. For example, automobiles and other machinery utilize electrical connectors to communicate data and/or electrical power therein. At least some known electrical connectors include a connector housing that has a cavity configured to receive another electrical connector (hereinafter referred to as a "mating connector"). The cavity opens to a front end of the connector housing and extends a depth into the connector housing. The electrical connector includes an array of electrical contacts, and the mating connector includes a complementary array of electrical contacts (hereinafter referred to as "mating contacts"). As the mating connector is received within the cavity, the electrical contacts are received within corresponding socket openings of the mating connector. Each socket opening may include one of the mating contacts that engages the corresponding electrical contact to establish an electrical connection.

Although the connector housing partially surrounds the electrical contacts within the receiving cavity, the electrical contacts may be exposed to the ambient environment through the open front end. During shipping or handling of the electrical connectors, contaminants may enter the receiving cavity through the front end. In addition, the front end may permit objects to enter the receiving cavity and engage the electrical contacts thereby moving and/or bending the electrical contacts. If an electrical contact is not positioned properly within the receiving cavity, the electrical contact may improperly engage the mating connector, an incident referred to as stubbing, which can damage the electrical contact. In some cases, the damage may require the electrical contact or, potentially, the entire electrical connector to be replaced.

Accordingly, there is a need for an electrical connector assembly having a mechanism for reducing exposure of the electrical contacts to the surrounding environment.

BRIEF DESCRIPTION

In an embodiment, electrical connector assembly is provided that includes a connector housing having a front end and a receiving cavity that opens to the front end. The receiving cavity is sized and shaped to receive a mating connector therein that is inserted into the receiving cavity along a central axis. The electrical connector assembly also includes a contact array of electrical contacts that is disposed within the receiving cavity. The electrical contacts have elongated bodies that extend generally parallel to the central axis through the receiving cavity. The electrical connector assembly also includes a movable guard that is configured to be slidably held by the contact array within the receiving cavity. The movable guard includes a dielectric sheet that extends transverse to the central axis and has an array of thru-holes. Each of the thru-holes is shaped by a corresponding inner edge of the dielectric sheet. The thru-holes include clearance thru-holes and frictional thru-holes. The inner edges of the frictional thru-holes engage corresponding electrical contacts of the contact array to hold the movable guard at a forward position within the receiving cavity. The clearance thru-holes permit corresponding electrical contacts of the contact array to move freely therethrough when aligned with the corresponding electrical contacts. The movable guard is configured to slide along the central axis from the forward position to a deeper position within the receiving cavity when engaged by the mating connector.

Optionally, the inner edges of the frictional through-holes of the electrical connector assembly are shaped to include projections that extend toward and directly engage the corresponding electrical contacts. In some embodiments, the electrical contacts of the electrical connector assembly are contact blades having a thickness and a width. The width may be greater than the thickness.

In some embodiments, the frictional thru-holes and the clearance thru-holes of the movable guard are distributed across the dielectric sheet to provide a substantially uniform mating resistance as the movable guard slides toward the deeper position. Optionally, the array of thru-holes may include a first section and a second section. The thru-holes of the first and second sections may be configured to receive electrical contacts having different first and second cross-sectional profiles, respectively. Optionally, the array of thru-holes includes multiple columns in which each column includes at least one of the frictional thru-holes.

In an embodiment, a communication system is provided that includes an electrical connector having a connector housing with a front end and a receiving cavity that opens to the front end. The electrical connector includes a contact array of electrical contacts within the receiving cavity. The electrical contacts extend parallel to each other along a central axis of the electrical connector. The connector housing has an interior rear wall that faces along the central axis and at least partially defines the receiving cavity. The communication system also includes a mating connector that is configured to be inserted into the receiving cavity in a mating direction along the central axis. The mating connector has a front wall and an array of passages that open to the front wall. Each of the passages includes a mating contact that engages a corresponding electrical contact of the contact array. The communication system also includes a movable guard that is configured to be slidably held by the contact array within the receiving cavity. The movable guard includes a dielectric sheet that extends transverse to the central axis and has an array of thru-holes. Each of the thru-holes is shaped by a corresponding inner edge of the dielectric sheet that engages a corresponding electrical contact of the contact array. The inner edge collectively holds the movable guard at a forward position within the receiving cavity and permits the movable guard to slide in the mating direction from the forward position to a deeper position within the receiving cavity. The movable guard is disposed between the rear wall and the front wall during operation.

Optionally, the thru-holes are frictional thru-holes and the array of thru-holes also includes clearance thru-holes that are shaped to permit corresponding electrical contacts of the contact array to move freely therethrough.

DETAILED DESCRIPTION

Figure 1:
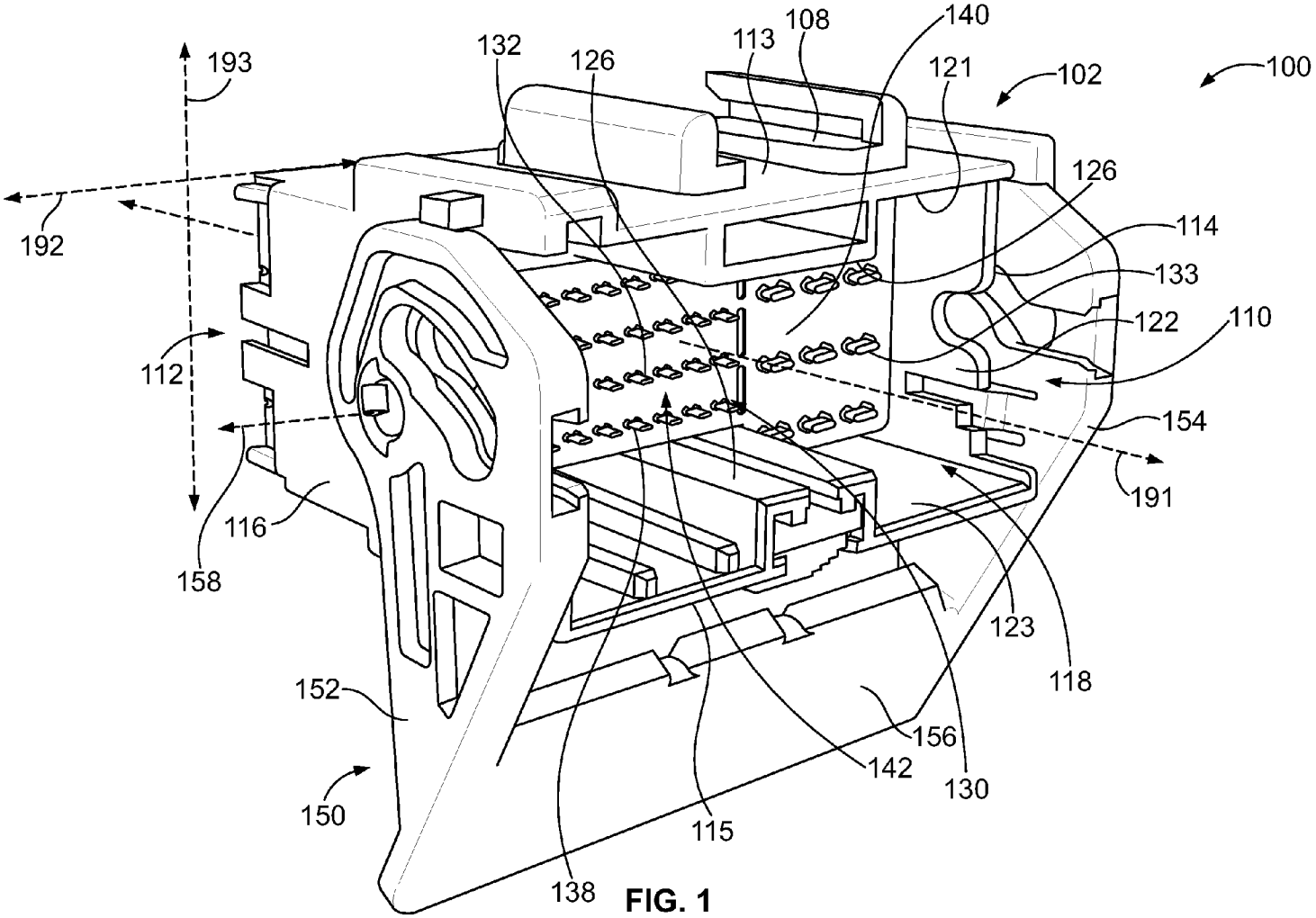
FIG. 1 is a perspective view of an electrical connector assembly in accordance with an embodiment.
Figure 2:
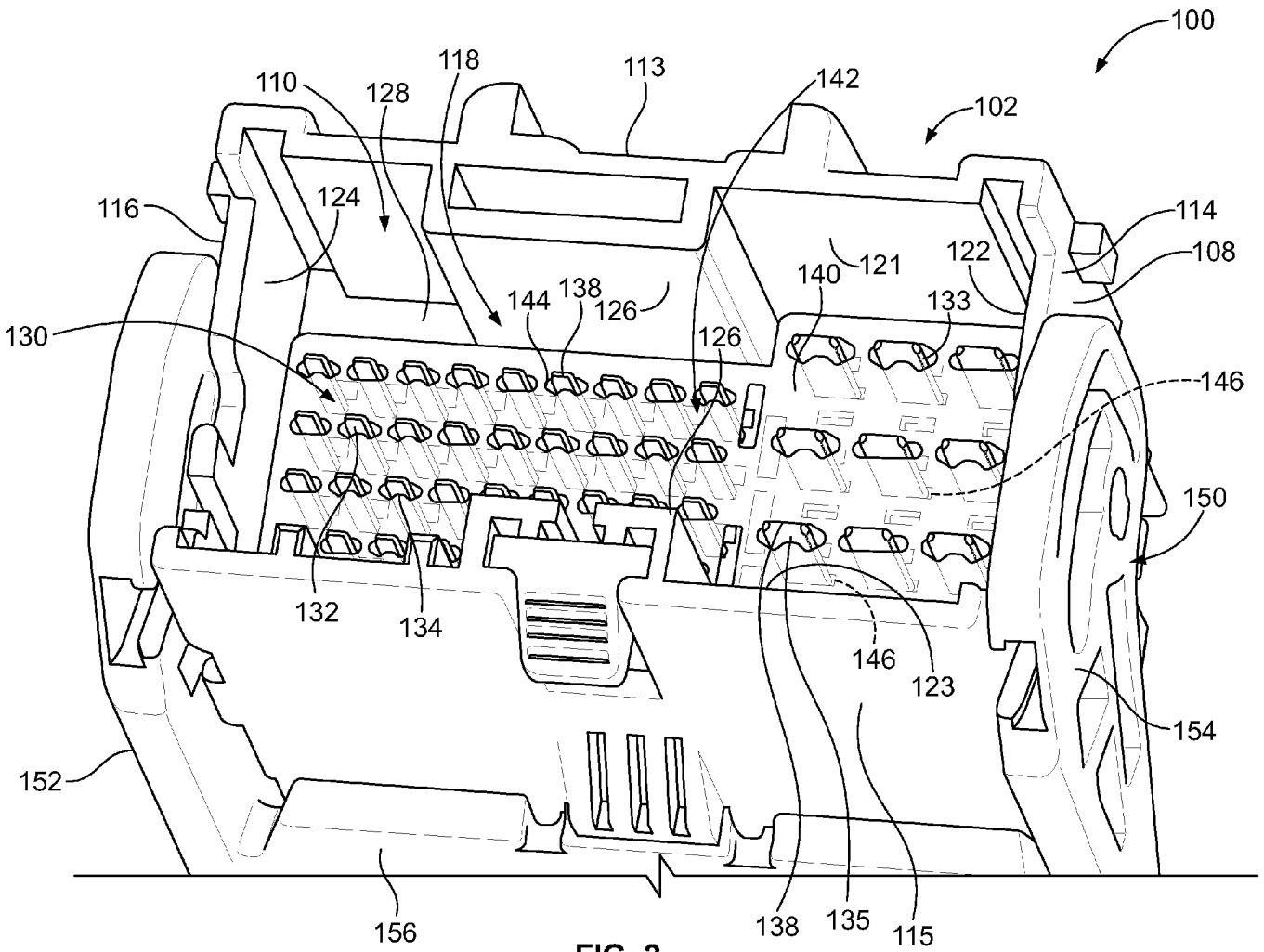
FIG. 2 is another perspective view of the electrical connector assembly shown in FIG. 1.

FIGS. 1 and 2 illustrate different perspective views of an electrical connector assembly 100 formed in accordance with an embodiment. The electrical connector assembly 100 includes an electrical connector 102 and a movable guard 140 that is slidably coupled to the electrical connector 102 as described herein. The electrical connector assembly 100 is configured to engage a mating connector 106 (shown in FIG. 6) during a mating operation. The electrical connector 102 includes a connector housing 108 having a front end 110 and a back wall 112 (FIG. 1) that face in generally opposite directions. The connector housing 108 also includes housing sides 113, 114, 115, 116 that extend between the front end 110 and the back wall 112. As shown in FIG. 1, the electrical connector assembly 100 is oriented with respect to mutually perpendicular axes, including a central axis 191, a first lateral axis 192, and a second lateral axis 193. Although the electrical connector assembly 100 shown in FIGS. 1 and 2 has a particular orientation, the electrical connector assembly 100 is not limited to a particular orientation during operation.

The connector housing 108 defines a receiving cavity 118 that opens to the front end 110. The receiving cavity 118 is sized and shaped to receive the mating connector 106 (FIG. 6) during the mating operation. During the mating operation, the electrical connector assembly 100 and the mating connector 106 are moved, relative to one another, such that the mating connector 106 is received within the receiving cavity 118. For example, the mating connector 106 may be inserted into the receiving cavity 118 as the electrical connector 102 is held in a stationary position. Alternatively, the mating connector 106 may be stationary as the electrical connector 102 is moved such that the mating connector 106 is received within the receiving cavity 118. In other embodiments, both the mating connector 106 and the electrical connector 102 are moved during the mating operation.

Figure 6:
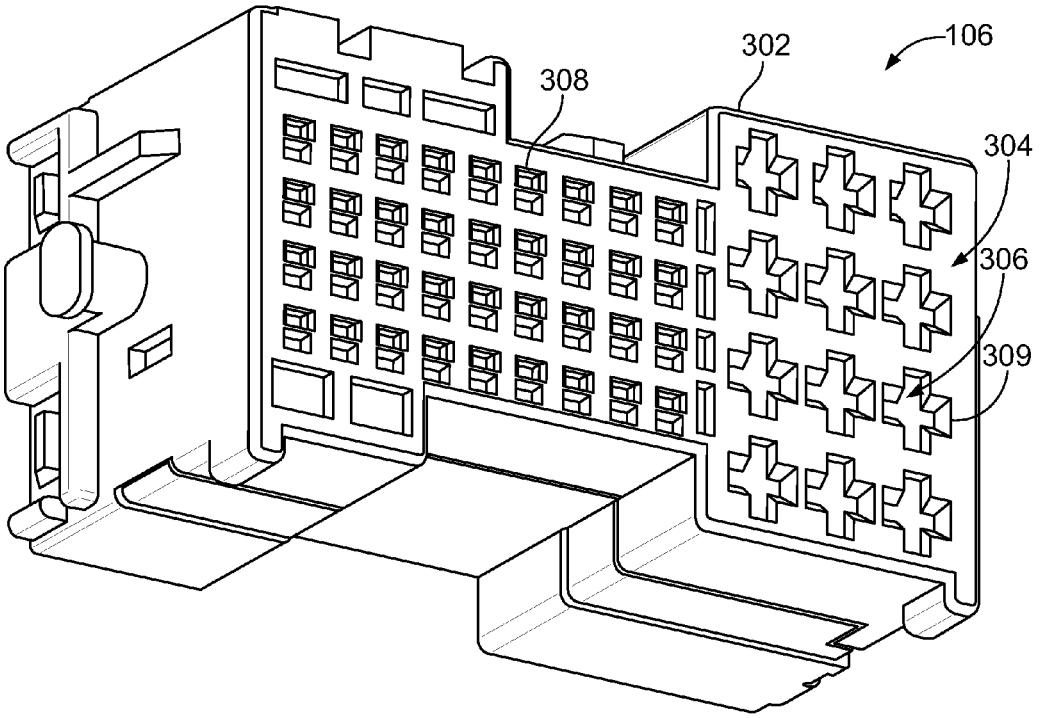
FIG. 6 is a perspective view of the mating connector that may engage the electrical connector assembly of FIG. 1.

The connector housing 108 includes interior sidewalls 121, 122, 123, and 124 that define the receiving cavity 118. The sidewall 124 is shown in FIG. 2. In the illustrated embodiment, the interior sidewalls 121-124 are shaped to include keying features 126. The keying features 126 may assure that the electrical connector assembly 100 and the mating connector 106 are properly oriented with respect to one another during the mating operation. The receiving cavity 118 may also be defined by an interior rear wall 128 (FIG. 2). The interior sidewalls 121-124 generally face toward the central axis 191. The rear wall 128 faces in a direction along the central axis 191. In some embodiments, each of the interior sidewalls 121-124 may interface with the mating connector 106 (FIG. 6).

The electrical connector 102 includes a contact array 130 of electrical contacts 132, 133 that are disposed within the receiving cavity 118. The electrical contacts 132, 133 include respective elongated bodies 134, 135 (shown in FIG. 2) that extend generally parallel to the central axis 191 and to one another. The elongated bodies 134, 135 extend from the rear wall 128 (FIG. 2) to a respective distal tip 138.

The movable guard 140 is configured to protect the contact array 130 prior to the mating operation. For example, the movable guard 140 may shield the electrical contacts 132, 133 from objects that inadvertently enter the receiving cavity 118. In some embodiments, the movable guard 140 may align and/or hold the electrical contacts 132, 133 in designated positions to reduce the likelihood of stubbing during the mating operation. Optionally, the movable guard 140 may be configured to function as a cover that reduces the likelihood of contaminants (e.g., dust) entering the receiving cavity 118. The movable guard 140 is configured to be held at a designated forward position, as shown in FIGS. 1 and 2, and move to a deeper position (shown in FIG. 7) during the mating operation. The movable guard 140 may remain within the receiving cavity 118 during the lifetime operation of the electrical connector assembly 100. As shown, the movable guard 140 may include an array 142 of thru-holes 144. The array 142 is patterned to match the contact array 130 such that the electrical contacts 132, 133 extend through the thru-holes 144.

The electrical connector assembly 100 may be constructed in various manners. For example, in some embodiments, the electrical contacts 132, 133 are inserted through passages 146 (FIG. 2) of the back wall 112 that open to the receiving cavity 118 along the rear wall 128. The electrical contacts 132, 133 are advanced through the passages 146 into the receiving cavity 118 in a direction that is parallel to the central axis 191. Prior to inserting the electrical contacts 132, 133, the movable guard 140 may be disposed within the receiving cavity 118. As the electrical contacts 132, 133 are inserted through the back wall 112 and the rear wall 128, the distal tip 138 of the electrical contacts 132, 133 is inserted through corresponding thru-holes 144. In other embodiments, the movable guard 140 may be positioned within the receiving cavity 118 after the electrical contacts 132, 133 are assembled into the contact array 130. For instance, each and every electrical contact 132, 133 may be operably positioned for engaging a corresponding mating contact of the mating connector 106. The movable guard 140 may then be disposed within the receiving cavity 118 such that the thru-holes 144 receive the corresponding electrical contacts 132, 133.

In the illustrated embodiment, the electrical connector assembly 100 includes a latching actuator 150 that is configured to engage the mating connector 106 and couple the mating connector 106 and the electrical connector assembly 100 to each other such that the mating connector 106 and the electrical connector assembly 100 remain secured to each other during operation. The latching actuator 150 may include a pair of rotatable levers 152, 154 and an operator-controlled panel 156 that extends between and joins the rotatable levers 152, 154. In FIG. 1, the latching actuator 150 is shown in a first rotational position. In FIG. 2, the latching actuator 150 is shown in a second rotational position. To move to the second rotational position, the latching actuator 150 may be rotated about an axis of rotation 158 (FIG. 1) such that the operator-controlled panel 156 is positioned adjacent to the housing side 115 as shown in FIG. 2. As described in greater detail below, the latching actuator 150 moves the mating connector 106 further into the receiving cavity 118 when the latching actuator 150 is rotated.

The electrical connector assembly 100 and the mating connector 106 (FIG. 6) may be wire-to-wire connector assemblies that each couple to and hold a bundle of wires. For example, the electrical contacts 132, 133 may be electrically coupled to or be parts of insulated wires 195 (shown in FIG. 5). The insulated wires 195 may include insulative jackets 196 (shown in FIG. 5) and wire conductors (not shown) that extend along a length of the corresponding wire. When the electrical connector assembly 100 and the mating connector 106 are mated, each insulated wire 195 may be electrically coupled, through the corresponding electrical contacts, to a corresponding insulated wire (not shown) of the mating connector 106. As such, the electrical connector assembly 100 and the mating connector 106 electrically connect different bundles of wires. In some embodiments, the electrical connector assembly 100 and the mating connector 106 are not secured to a structure such that the mated connectors (i.e., the electrical connector assembly 100 and the mating connector 106 secured to each other) are free-floating. In such embodiments, the mated connectors may be moved when either of the wire bundles is pulled.

Figure 3:
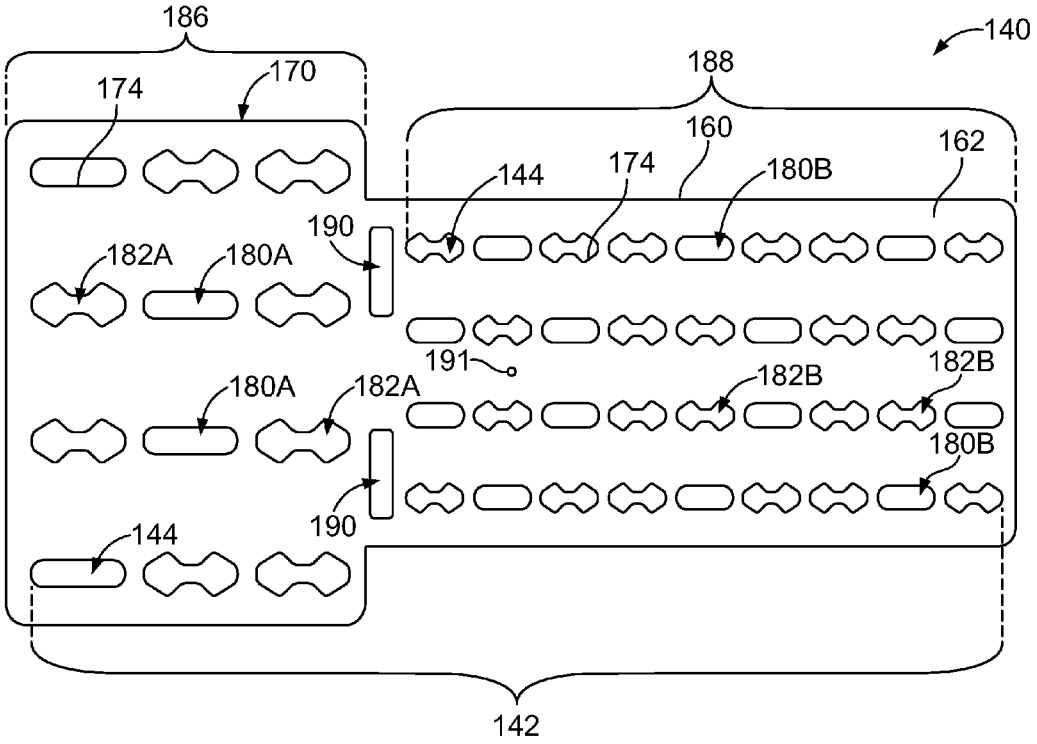
FIG. 3 is a plan view of a movable guard that may be used with the electrical connector assembly of FIG. 1.

FIG. 3 is an isolated plan view of the movable guard 140. The movable guard 140 includes a dielectric sheet 160 having a first sheet side 162 and an opposite second sheet side 164 (shown in FIG. 5). The first sheet side 162 is configured to engage or interface with the mating connector 106 (FIG. 6), and the second sheet side 164 is configured to engage or interface with the rear wall 128 (FIG. 2). In some embodiments, the movable guard 140 may function in either orientation such that the dielectric sheet 160 may be flipped and the first sheet side 162 engage or interface with the rear wall 128. The first and second sheet sides 162, 164 may be separated by a thickness 166 (shown in FIG. 5) of the dielectric sheet 160. By way of example, the thickness 166 may be between about 0.1 millimeters (mm) to about 0.5 mm. In more particular embodiments, the thickness 166 may be between about 0.15 mm to about 0.40 mm. In yet more particular embodiments, the thickness 166 may be between about 0.20 mm to about 0.30 mm. In an exemplary embodiment, the thickness 166 is substantially uniform throughout the dielectric sheet 160, except for the thru-holes 144, such that the dielectric sheet 160 constitutes a substantially planar body that is sheet-like or film-like.

The dielectric sheet 160 may comprise one or more non-conductive materials that are sufficiently rigid to function as described herein. By way of example only, the non-conductive material may include polyester or polyethylene. In particular embodiments, the dielectric sheet 160 includes biaxially-oriented polyethylene terephthalate (boPET). In some embodiments, the dielectric sheet 160 may be stamped from a dielectric film, such as a film that includes polyester or polyethylene. A single stamping operation may provide the array 142 of thru-holes 144 as shown in FIG. 3.

However, it should be understood that the dielectric sheet 160 is not limited to a particular material or materials, and that various other materials may be used to form the movable guard 140. In an exemplary embodiment, the dielectric sheet 160 is etched to form the array 142 of thru-holes 144. However, the array 142 may be formed by other methods. For instance, the dielectric sheet 160 may be stamped, molded, or 3D-printed to form the array 142 of thru-holes 144.

The dielectric sheet 160 includes an outer edge 170 that defines a perimeter of the dielectric sheet 160 when viewed along the central axis 191. In some embodiments, the outer edge 170 may interface with one or more of the interior sidewalls 121-124. For example, the outer edge 170 may be located immediately adjacent to, at least, the interior sidewall 122 (FIG. 1) and the interior sidewall 124 (FIG. 2). More specifically, the outer edge 170 may slidably engage the interior sidewalls 122, 124 and/or have a nominal gap therebetween. The interior sidewalls 122, 124 may position or locate the movable guard 140 within the receiving cavity 118 (FIG. 1) so that the thru-holes 144 may receive the corresponding electrical contacts. As the movable guard 140 moves to the deeper position, the interior sidewalls 122, 124 may engage the outer edge 170 to facilitate maintaining the movable guard 140 in a proper orientation. In some embodiments, the outer edge 170 may be located immediately adjacent to each of the interior sidewalls 121-124.

The perimeter (or profile) formed by the outer edge 170 may define a cover area of the movable guard 140 and may have a shape that is similar to an opening 240 (FIG. 5) defined by a leading edge 148 (FIG. 5) of the connector housing 108. As such, the dielectric sheet 160 may be sized and shaped to cover a substantial portion of the receiving cavity 118 (FIG. 1). In such embodiments, the dielectric sheet 160 may reduce the level of contaminants that enter the receiving cavity 118. In some embodiments, the cover area is at least 60% of a profile of the receiving cavity 118. In more particular embodiments, the cover area is at least 75% of the profile of the receiving cavity 118. The profile of the receiving cavity 118 may be defined by a cross-section of the connector housing 108 taken transverse to the central axis 191.

As described herein, the array 142 of thru-holes 144 is patterned to match the contact array 130 of electrical contacts 132, 133. More specifically, each of thru-holes 144 is configured to have a corresponding electrical contact 132 or 133 extend therethrough. As such, each of the thru-holes 144 is sized and shaped relative to the corresponding electrical contact 132 or 133. The thru-holes 144 may be defined by corresponding inner edges 174 of the dielectric sheet 160. For embodiments that are stamped from a film, the outer edges 170 and the inner edges 174 may be stamped edges. Stamped edges may have structurally different properties than edges of other dielectric sheets. For example, a dielectric sheet that is formed from an injection-molding process may have edges that exhibit different qualities or properties than edges that were formed through a stamping operation. The dielectric sheet that is formed from plastic may be more rigid than a dielectric sheet stamped from a film. The different qualities or properties of the different dielectric sheets may be identified by inspecting the dielectric sheets (e.g., using a microscope) or through other tests. As described herein, the array 142 of thru-holes 144 may facilitate assembling the electrical connector 102 by locating the electrical contacts 132, 133 within the receiving cavity 118. After assembly, the movable guard 140 may also substantially hold the electrical contacts 132, 133 within designated positions relative to one another.

The thru-holes 144 include clearance thru-holes 180A, 180B and frictional thru-holes 182A, 182B. Each of the thru-holes 180A, 180B, 182A, 182B have different sizes and shapes that are defined by the corresponding inner edges 174. For example, the inner edges 174 of the clearance thru-holes 180A, 180B are configured to permit the respective electrical contacts 132, 133 (FIG. 1) to move freely therethrough as the movable guard 140 within the receiving cavity 118 (FIG. 1). The inner edges 174 of the clearance thru-holes 180A, 180B may have a profile that is similar to, but larger than, a cross-sectional profile of the corresponding electrical contact. The inner edges 174 of the frictional thru-holes 182A, 182B, however, are configured to engage the respective electrical contacts 132, 133. For example, the inner edges 174 of the frictional thru-holes 182A, 182B may have at least one dimension that is smaller than a similar dimension of the corresponding electrical contacts such that the inner edges 174 must engage the corresponding electrical contacts.

In an exemplary embodiment, the frictional forces generated between the inner edges 174 of the frictional thru-holes 182A, 182B and the respective electrical contacts 132, 133 are sufficient to hold the movable guard 140 within the receiving cavity 118. For example, the movable guard 140 may be retained at the forward position in any orientation with respect to gravity and, in some embodiments, may remain at the forward position even if the electrical connector assembly 100 is dropped from a distance of 20 millimeters or less. In particular embodiments, the movable guard 140 may remain at the forward position even if the electrical connector assembly 100 is dropped from a distance of 1 meter or less.

As shown in FIG. 3, the array 142 may include a first section 186 and a second section 188. The first section 186 of the array 142 is configured to receive the electrical contacts 132, and the second section 188 of the array 142 is configured to receive the electrical contacts 133. The first section 186 includes the clearance thru-holes 180A and the frictional thru-holes 182A. The second section 188 includes the clearance thru-holes 180B and the frictional thru-holes 182B. In other embodiments, the array 142 may include only one section or more than two sections. In alternative embodiments, the thru-holes 144 are not separated into different section but, instead, are mixed within the array 142.

Collectively, the frictional thru-holes 182A, 182B may provide a mating resistance during the mating operation. For example, the frictional forces generated between the inner edges 174 and the corresponding electrical contacts 132, 133 impede movement of the movable guard 140 toward the rear wall 128 (FIG. 2). The number of frictional thru-holes 182A, 182B may be configured such that the mating resistance does not exceed a designated force. As shown, the dielectric sheet 160 includes 30 the frictional thru-holes 182A, 182B out of a total of 48 thru-holes 144. In an exemplary embodiment, the mating resistance does not change based on a depth of the dielectric sheet 160.

The clearance thru-holes 180A, 180B and the frictional thru-holes 182A, 182B may be distributed across the dielectric sheet 160 to provide a substantially uniform mating resistance during the mating operation. For instance, the clearance thru-holes 180A, 180B and the frictional thru-holes 182A, 182B may be positioned relative to each other so that the frictional thru-holes 182A, 182B are not overly concentrated within one or more particular portions of the array 142.

In some embodiments, the mating resistance may also include frictional forces generated between the outer edge 170 and one or more portions of the connector housing 108. For example, the outer edge 170 may engage one or more of the interior sidewalls 121-124 (FIGS. 1 and 2). In some embodiments, the dielectric sheet 160 includes thru-holes 190. The thru-holes 190 may receive one or more projections from the mating connector 106. Alternatively, the thru-holes 190 may receive one or more projections from the connector housing 108. Such projections may be used to align the movable guard and/or provide a designated mating resistance during the mating operation.

Figure 4:
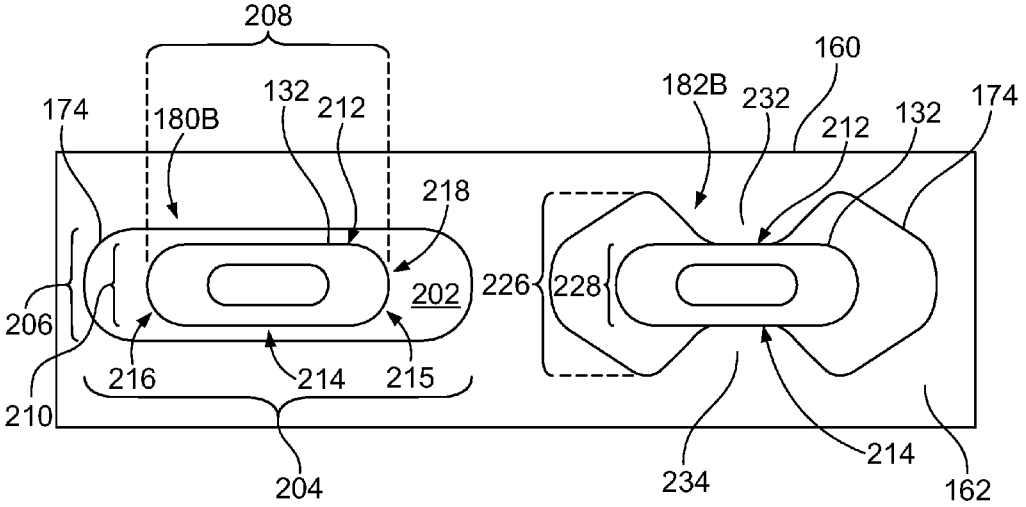
FIG. 4 is an enlarged plan view of a portion of the movable guard of FIG. 3 slidably engaged to electrical contacts of the electrical connector assembly.

FIG. 4 is an enlarged plan view of a portion of the dielectric sheet 160 slidably engaged to corresponding electrical contacts 132. In an exemplary embodiment, the electrical contacts 132 are configured to transmit data signals and the electrical contacts 133 (FIG. 1) are configured to transmit electrical power. In alternative embodiments, both of the electrical contacts 132 and 133 may transmit data signals or, alternatively, both of the electrical contacts 132 and 133 may transmit electrical power. Although the following is with specific reference to the electrical contacts 132 and the clearance and frictional thru-holes 180B, 182B in FIG. 4, the description may be similarly applied to the electrical contacts 133 and the clearance and frictional thru-holes 180A, 182A (FIG. 3).

With respect to the clearance thru-hole 180B, the inner edge 174 of the clearance thru-hole 180B is shaped relative to the corresponding electrical contact 132 such that a gap or clearance 202 exists between an outer surface 215 of the electrical contact 132 and the inner edge 174. More specifically, when the clearance thru-hole 180B is aligned with the corresponding electrical contact 132, the gap or clearance 202 exists and the electrical contact 132 is permitted to move freely therethrough. The clearance thru-hole 180B has a width 204 and a height or height 206. The electrical contact 132 has a width 208 and a thickness 210. In an exemplary embodiment, the electrical contact 132 is a contact blade such that the width 208 is substantially greater than the thickness 210. For example, the width 208 may be about two times (2×) to four times (4×) greater than the thickness 210. As such, the electrical contact 132 has opposite broad sides 212, 214 and opposite short sides 216, 218. The short sides 216, 218 may have a curved contour as shown in FIG. 4. The width 204 and the height 206 of the clearance thru-hole 180B may be dimensioned such that the shape of the inner edge 174 is similar to a cross-sectional profile of the electrical contact 132. More specifically, the width 204 may be slightly greater than the width 208 and the height 206 may be slightly greater than the thickness 210.

In FIG. 4, the electrical contact 132 has an ideal, central position within the clearance thru-hole 180B. In the central position, the gap 202 surrounds an entirety of the electrical contact 132. It should be understood that, due to tolerances in the assembly process, the electrical contact 132 may have a different position. For example, the electrical contact 132 may be closer to one or more segments of the inner edge 174 or, in some cases, the outer surface 215 of the electrical contact 132 may directly engage the inner edge 174. As shown, electrical contact 132 reduces or tapers in size at the distal tip 138. As the electrical contact 132 is received through the clearance thru-hole 180B, if the electrical contact 132 engages the inner edge 174, the tapered distal tip 138 may operate to re-direct the electrical contact 132 to a sufficiently aligned position.

The frictional thru-hole 182B has a different shape than the clearance thru-hole 180B. The inner edge 174 is configured to directly engage the electrical contact 132. As shown, the frictional thru-hole 182B has a width 224 and a varying height that changes between a first height 226 and a second height 228. The width 224 may be substantially equal to the width 204 of the clearance thru-hole 180B.

Unlike the height 206, however, the frictional thru-hole 182B has a varying height. As shown, the first height 226 is greater than the height 206 and the second height 228 is less than the height 206. In such embodiments, the inner edge 174 of the frictional through-hole 182B may be shaped to include projections 232, 234 that extend toward and directly engage the corresponding electrical contact 132. The projection 232 engages the broad side 212 of the corresponding electrical contact 132, and the projection 234 engages the broad side 214 of the corresponding electrical contact 132.

As the corresponding electrical contact 132 is inserted through the frictional thru-hole 182B, the projections 232, 234 may engage the broad sides 212, 214, respectively. In some embodiments, such as those that are stamped from a dielectric film, the projections 232, 234 may function as flaps that bend slightly away from the first sheet side 162 to permit the electrical contact 132 to slide therethrough. Resistance to bending by the projections 232, 234 may be based, in part, on the differences between the heights 226, 228. Nonetheless, the projections 232, 234 directly engage the electrical contact 132 and generate the frictional forces therebetween. In the illustrated embodiment, the projections 232, 234 extend toward each other. In other embodiments, the projections 232, 234 do not extend toward each other. Yet in other embodiments, the inner edge 174 defines only one projection or more than two projections that engage the electrical contact.

For embodiments in which the projections 232, 234 are permitted to bend slightly, the frictional forces that initially hold the movable guard 140 within the receiving cavity 118 may be greater than the frictional forces that resist movement of the movable guard 140 after the movable guard 140 has been displaced during the mating operation. Likewise, for embodiments in which the dielectric sheet 160 is a dielectric film, the frictional forces that resist movement of the movable guard 140 may be less than the frictional forces that are generated by plastic plates in known systems. Accordingly, compared to known systems, embodiments set forth herein may allow movement of the movable guard 140 when a lower mating force is applied.

The inner edges 174 of the frictional thru-holes 182A, 182B directly engage the corresponding electrical contacts 132, 133 to hold the movable guard 140 at the forward position within the receiving cavity 118. For example, the projections 232, 234 may pinch the corresponding electrical contact therebetween such that each of the projections 232, 234 presses against the corresponding electrical contact. In some embodiments, when the electrical contacts 132, 133 are aligned with the frictional thru-holes 182A, 182B, the electrical contacts 132, 133 must engage the inner edges 174 of the frictional thru-holes 182A, 182B. In other words, the electrical contacts 132, 133 are not permitted to move freely through the frictional thru-holes 182A, 182B without engaging the inner edges 174.

The forces provided by the projections 232, 234 may oppose each other. The inner edges 174 of the clearance thru-holes 180A, 180B, however, may not provide opposing forces. Under certain circumstances, the inner edges 174 of the clearance thru-holes 180A, 180B may inadvertently or nominally engage the corresponding electrical contacts 132, 133. In some embodiments, however, the frictional forces between the inner edges 174 of the clearance thru-holes 180A, 180B may be insubstantial compared to the frictional forces generated by the inner edges 174 of the frictional thru-holes 182A, 182B.

Figure 5:
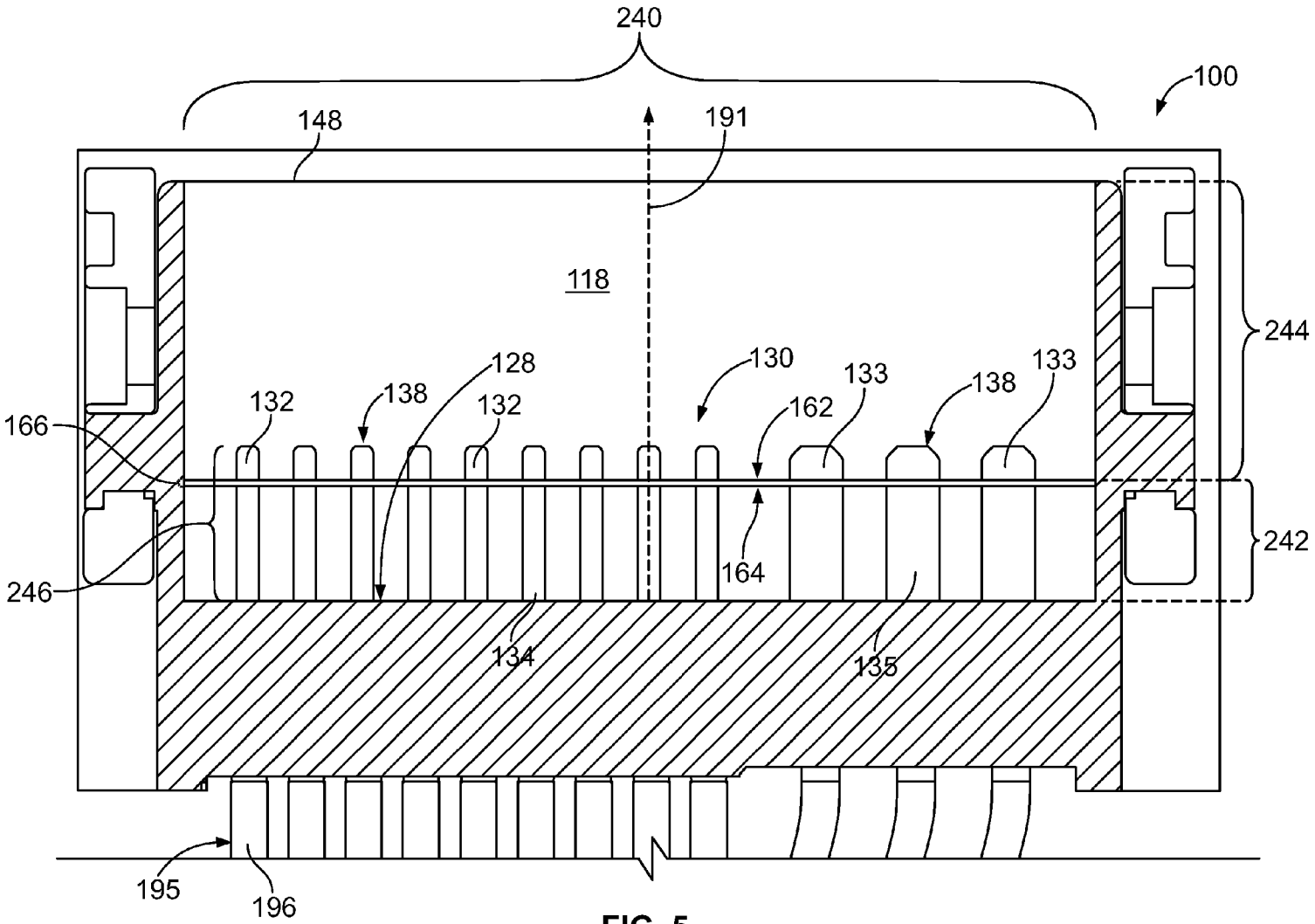
FIG. 5 is a cross-section of the electrical connector assembly of FIG. 1 prior to engaging a mating connector.

FIG. 5 is a cross-section of the electrical connector assembly 100 prior to engaging a mating connector 106 (FIG. 6). The front end 110 has an opening 240 to the receiving cavity 118 that is defined by the leading edge 148. The opening 240 and the receiving cavity 118 are sized and shaped relative to the mating connector 106 to receive the mating connector 106 during the mating operation. As shown, the electrical contacts 132, 133 of the contact array 130 are disposed within the receiving cavity 118.

As shown, the movable guard 140 (or the dielectric sheet 160) extends transverse to the central axis 191 and to the elongated bodies 134, 135 of the electrical contacts 132, 133, respectively. For example, the central axis 191 may be orthogonal or perpendicular to the dielectric sheet 160. The first sheet side 162 faces toward the front end 110 in a direction that is along the central axis 191. The second sheet side 164 faces the rear wall 128. In FIG. 5, the movable guard 140 is disposed at a forward position. In the forward position, the movable guard 140 is located at a height 242 that is measured from the rear wall 128 and at a depth 244 that is measured from the opening 240 (or the leading edge 148). Also shown, the electrical contacts 132, 133 have a common height 246 measured from the rear wall 128 to the distal tips 138. The height 246 is greater than the height 242. In alternative embodiments, the electrical contacts 132, 133 may not have a common height. As described herein, the frictional forces generated between the electrical contacts 132, 133 may collectively hold the movable guard 140 in the forward position prior to the mating operation.

Figure 7:
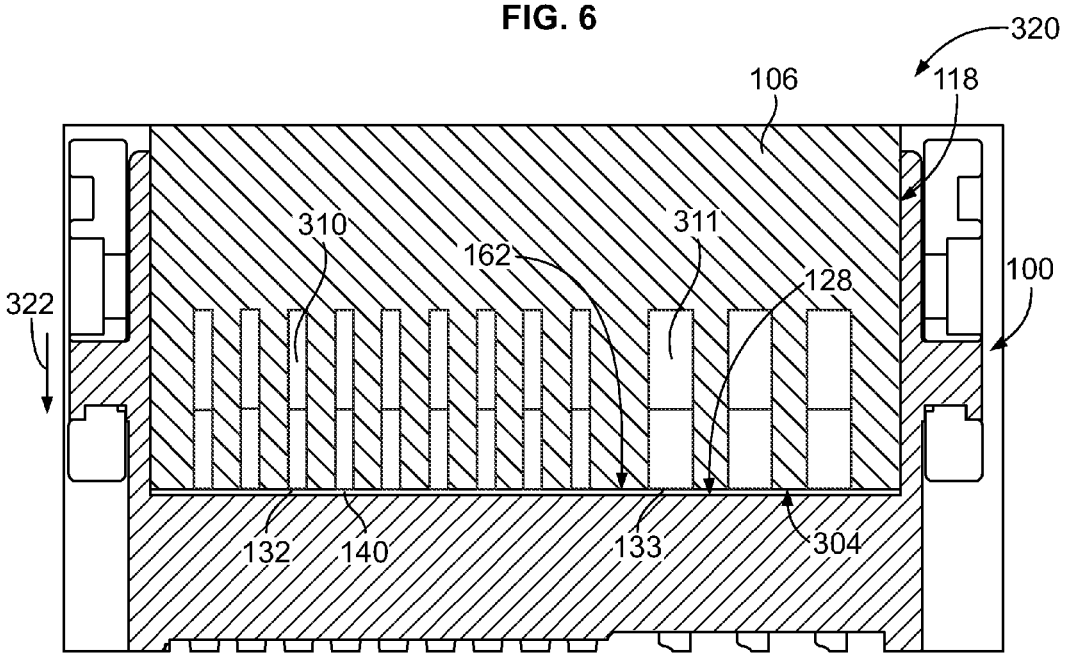
FIG. 7 is a cross-section of a communication system in accordance with an embodiment that includes the electrical connector assembly of FIG. 1 and the mating connector of FIG. 6.

FIG. 6 is a perspective view of the mating connector 106. The mating connector 106 has a connector housing 302 that includes a front wall 304. The front wall 304 is configured to engage the first sheet side 162 (FIG. 3) of the movable guard 140 (FIG. 1) during the mating operation. The connector housing 302 includes an array 306 of passages 308, 309 that open to the front wall 302. The mating connector 106 may include an array of mating contacts 310, 311 (FIG. 7). For example, the passages 308, 309 may include mating contacts 310, 311, respectively.

FIG. 7 is a cross-section of a communication system 320 in accordance with an embodiment after the mating operation. The communication system 320 includes the mating connector 106 and the electrical connector assembly 100. During the mating operation, the front wall 304 engages the first sheet side 162 of the movable guard 140 and moves the movable guard 140 in a mating direction 322 along the central axis 191 (FIG. 1) toward the rear wall 128. As shown, the movable guard 140 is disposed between the front wall 304 and the rear wall 128. During operation of the communication system 320, the movable guard 140 may remain within the receiving cavity 118.

In some embodiments, the latching actuator 150 completes the mating operation. For example, the mating connector 106 may be inserted into the receiving cavity 118 until the mating connector 106 is located at a designated position. The latching actuator 150 may then be rotated about the axis 158. As the latching actuator 150 is rotated, the latching actuator 150 may drive the mating connector 106 and the movable guard 140 toward the rear wall 128 until the mating connector 106 and the movable guard 140 achieve the designated positions shown in FIG. 7.

When the electrical connector assembly 100 and the mating connector 106 are mated as shown in FIG. 7, the electrical contacts 132, 133 are directly engaged to the mating contacts 310, 311, respectively. Accordingly, data and/or electrical power may be transmitted through the communication system 320.

Figure 8:
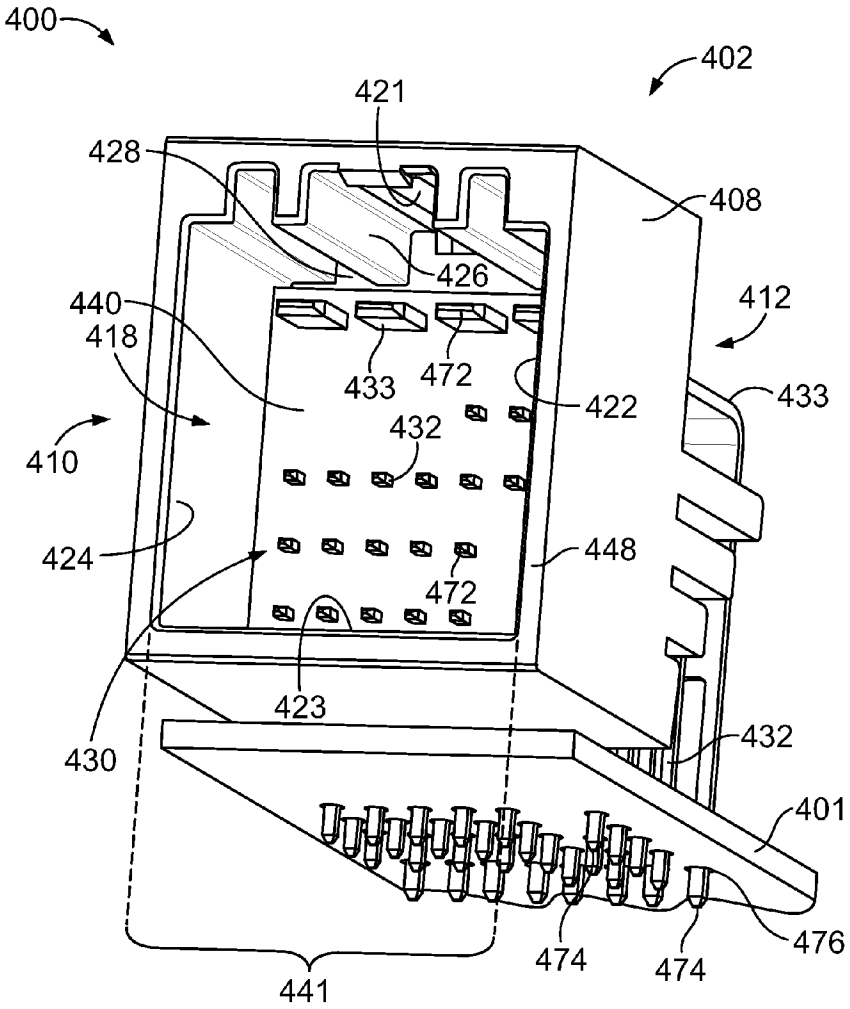
FIG. 8 is a perspective view of an electrical connector assembly formed in accordance with an embodiment that is communicatively coupled to a circuit board.

FIG. 8 is a perspective view of an electrical connector assembly 400 formed in accordance with an embodiment that is mounted to a circuit board 401. The electrical connector assembly 400 includes an electrical connector 402 and a movable guard 440 that is slidably coupled to the electrical connector 402. The electrical connector 402 and the movable guard 440 may have similar features as the electrical connector 102 (FIG. 1) and the movable guard 140 (FIG. 1), respectively. Although not shown, the electrical connector 402 is configured to engage a mating connector, which may be similar to the mating connector 106 (FIG. 6). The electrical connector 102 includes a connector housing 408 having a front end 410 and a back wall 412 that face in generally opposite directions.

The connector housing 408 defines a receiving cavity 418 that opens to the front end 410. The receiving cavity 418 is sized and shaped to receive the mating connector (not shown) during the mating operation. The connector housing 408 includes interior sidewalls 421, 422, 423, and 424 that define the receiving cavity 418. In the illustrated embodiment, the interior sidewall 421 is shaped to include keying features 426. The receiving cavity 118 may also be defined by an interior rear wall 428. The rear wall 428 faces in a direction toward the front end 410. In some embodiments, each of the interior sidewalls 421-424 may interface with the mating connector when the mating connector and the electrical connector 402 are engaged.

The electrical connector 402 includes a contact array 430 of electrical contacts 432, 433 that are disposed within the receiving cavity 418. The electrical contacts 432, 433 may be similar or identical to the electrical contacts 132, 133 (FIG. 1). For example, the electrical contacts 432, 433 may be contact blades. The movable guard 440 is configured to protect the contact array 430 prior to the mating operation. For example, the movable guard 440 may shield the electrical contacts 432, 433 from objects that inadvertently enter the receiving cavity 418. In some embodiments, the movable guard 440 may align and/or hold the electrical contacts 432, 433 in designated positions to reduce the likelihood of stubbing during the mating operation. Optionally, the movable guard 440 may be configured to function as a cover that reduces the likelihood of contaminants (e.g., dust) entering the receiving cavity 418. Similar to the movable guard 140 (FIG. 1), the movable guard 440 is configured to be held at a designated forward position and move to a deeper position during the mating operation.

Figure 9:
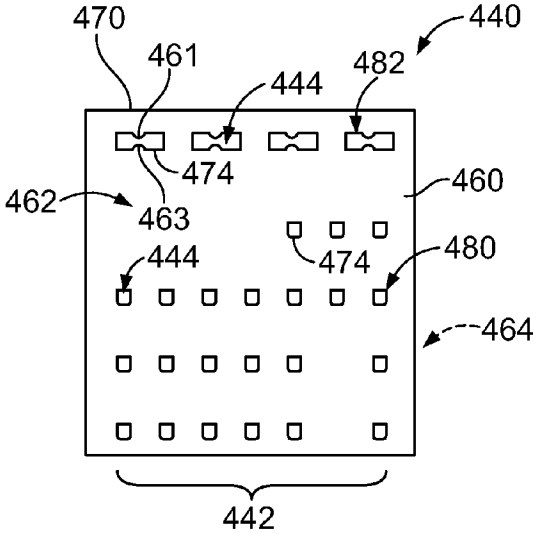
FIG. 9 is a perspective view of a movable guard that may be used with the electrical connector assembly of FIG. 8.

FIG. 9 is a perspective view of the movable guard 440. The movable guard 440 includes an array 442 of thru-holes 444. The array 442 is patterned to match the contact array 430 (FIG. 8) such that the electrical contacts 432, 433 (FIG. 8) extend through the thru-holes 444. The movable guard 440 may have similar features as the movable guard 140. For example, the movable guard 444 includes a dielectric sheet 460 having a first sheet side 462 and an opposite second sheet side 464. The first sheet side 462 is configured to engage or interface with the mating connector (not shown), and the second sheet side 464 is configured to engage or interface with the rear wall 428 (FIG. 8). The first and second sheet sides 462, 464 may be separated by a thickness of the dielectric sheet 460, which may be similar to the thickness 166 (FIG. 5) described above. The dielectric sheet 460 may be manufactured in various manners, such as those described above with respect to the dielectric sheet 160. In certain embodiments, the dielectric sheet 460 is stamped from a dielectric film.

The dielectric sheet 460 includes an outer edge 470 that defines a perimeter of the dielectric sheet 460. In some embodiments, the outer edge 470 may interface with one or more of the interior sidewalls 421-424 (FIG. 8). For example, the outer edge 470 may be located immediately adjacent to the interior sidewalls 422-424. The interior sidewalls 421-424 may position or locate the movable guard 440 within the receiving cavity 418 (FIG. 8) so that the thru-holes 444 receive the corresponding electrical contacts. As the movable guard 440 moves to the deeper position, the interior sidewalls 421-424 may engage the outer edge 470 to facilitate maintaining the movable guard 440 in a proper orientation. In some embodiments, the outer edge 470 may be located immediately adjacent to each of the interior sidewalls 421-424.

The perimeter (or profile) formed by the outer edge 470 may define a cover area of the movable guard 440 and may have a shape that is similar to an opening 441 (FIG. 8) defined by a leading edge 448 (FIG. 8) of the connector housing 408. As such, the dielectric sheet 460 may be sized and shaped to cover a substantial portion of the receiving cavity 418 (FIG. 1). In such embodiments, the dielectric sheet 460 may reduce the level of contaminants that enter the receiving cavity 418. In some embodiments, the cover area is at least 60% of a profile of the receiving cavity 418. In more particular embodiments, the cover area is at least 75% of the profile of the receiving cavity 418.

The thru-holes 444 may be defined by corresponding inner edges 474 of the dielectric sheet 460. The thru-holes 444 include clearance thru-holes 480 and frictional thru-holes 482. The inner edges 474 of the clearance thru-holes 480 may be configured to permit the electrical contacts 432 (FIG. 8) to pass freely therethrough when the movable guard 440 is aligned with the contact array 430 (FIG. 8). The inner edges 474 of the frictional thru-holes 482 are configured to engage the respective electrical contacts 433 (FIG. 8). For example, the inner edges 474 may define opposing projections 461, 463 for each of the frictional thru-holes 482.

Returning to FIG. 8, the electrical contacts 432, 433 may be stamped and formed. Each of the electrical contacts 432, 433 may extend lengthwise between a corresponding first end 472 and a corresponding second end 474. The first ends 472 may represent distal ends of the electrical contacts 432, 433 that are inserted through corresponding passages (not shown) of the connector housing 408 such that the first ends 472 are exposed within the receiving cavity 418. The second ends 474 may be inserted into plated thru-holes 476 of the circuit board 401. In such embodiments, the electrical connector assembly 400 may be part of a device, such as an electrical device 500 shown in FIG. 10.

Figure 10:
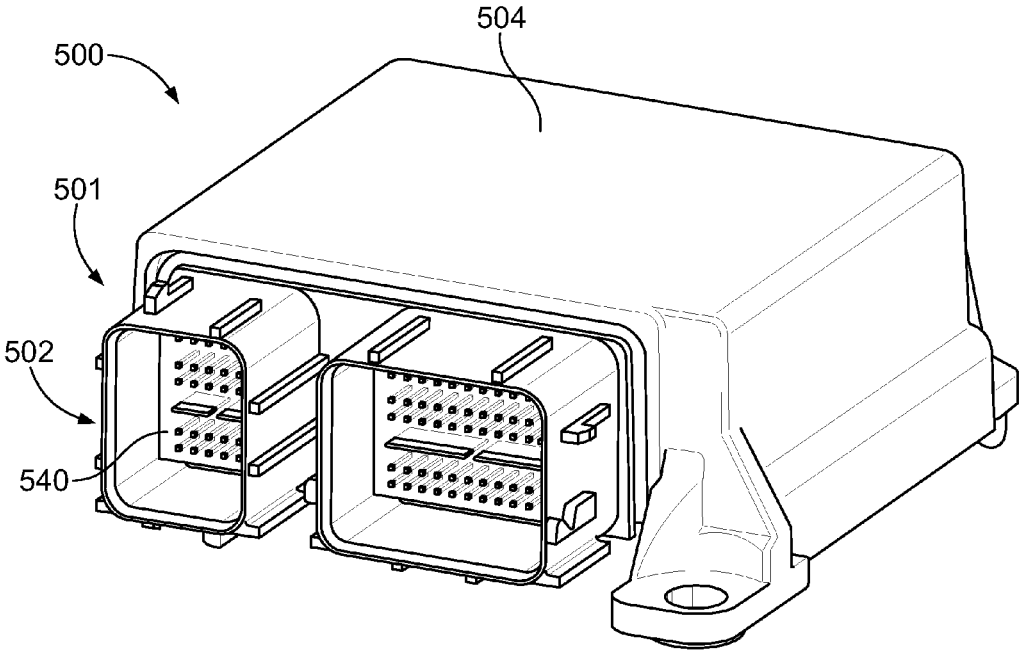
FIG. 10 is a perspective view of an electrical device formed in accordance with an embodiment.
Figure 11:
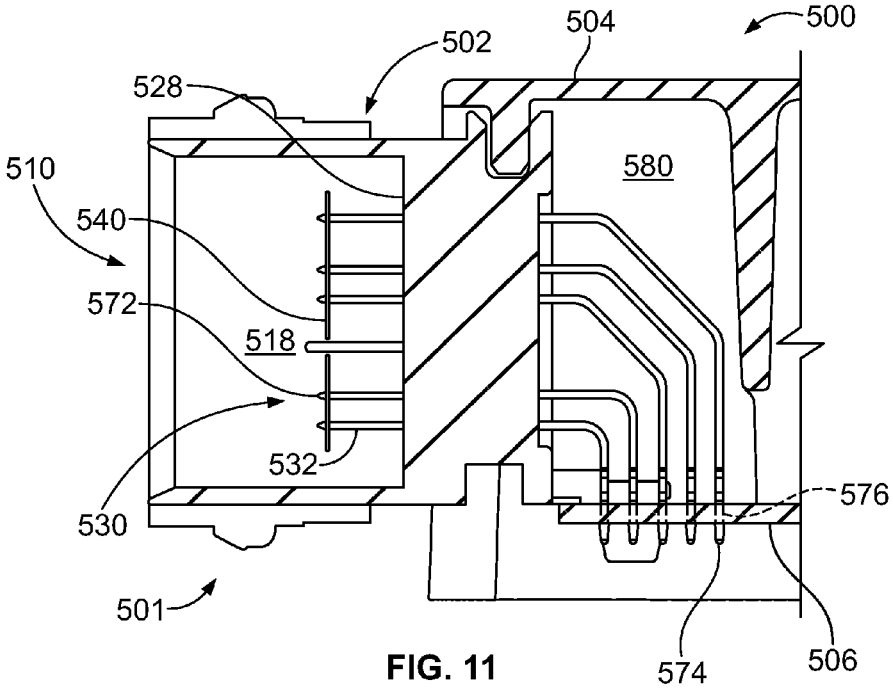
FIG. 11 is a cross-section of the electrical device of FIG. 10.

FIG. 10 is a perspective view of the electrical device 500, and FIG. 11 is a cross-section of the electrical device 500. The electrical device 500 includes an electrical connector assembly 501, a device housing 504, and a circuit board 506 (FIG. 11). The electrical connector assembly 501 includes an electrical connector 502 and a movable guard 540 that is slidably coupled to the electrical connector 502. The electrical connector 502 may be similar to the electrical connector 102 (FIG. 1) and the electrical connector 402 (FIG. 8). The electrical device 500 is configured to engage a mating connector (not shown) during a mating operation. The electrical device 500 may be secured to a structure (not shown) through the device housing 504.

With respect to FIG. 11, the electrical connector 502 includes a connector housing 508 that defines a receiving cavity 518 that opens to a front end 510 of the electrical connector 502. The receiving cavity 518 is sized and shaped to receive the mating connector (not shown) during the mating operation. The connector housing 508 includes an interior rear wall 528 that defines a portion of the receiving cavity 518. The rear wall 528 faces in a direction toward the front end 510.

The electrical connector 502 includes a contact array 530 of electrical contacts 532 that are disposed within the receiving cavity 518. The electrical contacts 532 may be similar or identical to the electrical contacts 132 (FIG. 1) or 432 (FIG. 8). The movable guard 540 is configured to protect the contact array 530 prior to the mating operation. Although not indicated in FIG. 11, the movable guard 540 includes an array of thru-holes that are patterned to match the contact array 530. The movable guard 540 may have similar features as the movable guard 140 (FIG. 1) or the movable guard 440 (FIG. 8).

Similar to the electrical contacts 432, 433 (FIG. 8), the electrical contacts 532 may be stamped and formed. As shown, each of the electrical contacts 532 extend lengthwise between a corresponding first end 572 and a corresponding second end 574. The first ends 574 represent distal ends of the electrical contacts 532 that are exposed within the receiving cavity 518. The second ends 574 are inserted into plated thru-holes 576 of the circuit board 506. The electrical contacts 532 extend through a housing cavity 580 that is defined by the device housing 504. The connector housing 508 is secured to the circuit board 506 and to the device housing 504 such that the connector housing 508 has a fixed position with respect to the circuit board 506 and the device housing 504.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector assembly comprising:

a connector housing having a front end and a receiving cavity that opens to the front end, the receiving cavity being sized and shaped to receive a mating connector therein that is inserted into the receiving cavity along a central axis of the connector housing;

a contact array of electrical contacts disposed within the receiving cavity, the electrical contacts having corresponding elongated bodies that extend generally parallel to the central axis; and a movable guard configured to be slidably held by the contact array within the receiving cavity, the movable guard comprising a dielectric sheet that extends transverse to the central axis and has an array of thru-holes, each of the thru-holes being shaped by a corresponding inner edge of the dielectric sheet, the thru-holes including clearance thru-holes and frictional thru-holes, wherein the inner edges of the frictional thru-holes engage corresponding electrical contacts of the contact array, the inner edges of the frictional thru-holes and the corresponding electrical contacts generating frictional forces to hold the movable guard at a forward position within the receiving cavity, the clearance thru-holes being shaped relative to corresponding electrical contacts of the contact array such that the corresponding electrical contacts are permitted to move freely therethrough when the clearance thru-holes are aligned with the corresponding electrical contacts, the movable guard configured to slide along the central axis from the forward position to a deeper position within the receiving cavity when engaged by the mating connector, wherein the inner edge for each of the frictional thru-holes forms at least one projection that extends toward and engages the corresponding electrical contact.

2. The electrical connector assembly of claim 1, wherein the the at least one projection includes first and second projections, the first and second projections extending generally toward each other and engaging the corresponding electrical contact to pinch the electrical contact therebetween.

3. The electrical connector assembly of claim 1, wherein the frictional thru-holes and the clearance thru-holes are distributed across the dielectric sheet to provide a substantially uniform mating resistance as the movable guard slides toward the deeper position.

4. The electrical connector assembly of claim 1, wherein the array of thru-holes includes a first section and a second section, the thru-holes of the first and second sections configured to receive electrical contacts having different first and second cross-sectional profiles, respectively.

5. The electrical connector assembly of claim 1, wherein the receiving cavity is defined by interior sidewalls that generally face the central axis, the dielectric sheet having an outer edge that defines a perimeter of the movable guard, wherein the outer edge interfaces with at least one of the interior sidewalls and slides along the at least one interior sidewall as the movable guard moves to the deeper position.

6. The electrical connector assembly of claim 1, wherein the electrical contacts are contact blades having a thickness and a width, the width being greater than the thickness.

7. The electrical connector assembly of claim 1, wherein the dielectric sheet comprises a dielectric film, the inner edges being stamped edges.

8. The electrical connector assembly of claim 7, wherein the dielectric film has a thickness between 0.1 millimeter and 0.5 millimeter.

9. The electrical connector assembly of claim 1, wherein the frictional forces collectively hold the movable guard at the forward position at any orientation with respect to gravity.

10. The electrical connector assembly of claim 1, wherein the corresponding electrical contacts and the frictional thru-holes are sized and shaped relative to one another such that the corresponding electrical contacts are not permitted to move freely through the frictional thru-holes without engaging the inner edges of the frictional thru-holes.

11. The electrical connector assembly of claim 1, wherein at least some of the electrical contacts that engage the inner edges of the frictional thru-holes have a first cross-sectional profile and at least some of the electrical contacts aligned with the clearance thru-holes have a second cross-sectional profile, the first and second cross-sectional profiles being identical, the frictional thru-holes and the clearance thru-holes having different shapes.

12. An electrical connector assembly comprising:

a connector housing having a front end and a receiving cavity that opens to the front end, the receiving cavity being sized and shaped to receive a mating connector therein that is inserted into the receiving cavity along a central axis of the connector housing;

a contact array of electrical contacts disposed within the receiving cavity, the electrical contacts having corresponding elongated bodies that extend generally parallel to the central axis; and a movable guard configured to be slidably held by the contact array within the receiving cavity, the movable guard comprising a dielectric sheet that extends transverse to the central axis and has an array of thru-holes, each of the thru-holes being shaped by a corresponding inner edge of the dielectric sheet, the inner edges forming projections that extend toward and directly engage the corresponding electrical contacts to hold the movable guard at a forward position within the receiving cavity, the movable guard configured to slide along the central axis from the forward position to a deeper position within the receiving cavity when engaged by the mating connector, the corresponding electrical contacts moving through the thru-holes as the movable guard slides from the forward position to the deeper position when engaged by the mating connector.

13. The electrical connector assembly of claim 12, wherein the projections are first projections, each of the inner edges including one of the first projections and forming a second projection, each of the first and second projections of the corresponding inner edge engaging the corresponding electrical contact.

14. The electrical connector assembly of claim 13, wherein the first and second projections extend generally toward each other and engage the corresponding electrical contact to pinch the electrical contact therebetween.

15. The electrical connector assembly of claim 12, wherein the thru-holes are frictional thru-holes and the array also includes clearance thru-holes, the clearance thru-holes permitting corresponding electrical contacts of the contact array to move freely therethrough when aligned with the corresponding electrical contacts.

16. The electrical connector assembly of claim 15, wherein the frictional thru-holes and the clearance thru-holes are distributed across the dielectric sheet to provide a substantially uniform mating resistance as the movable guard slides toward the deeper position.

17. The electrical connector assembly of claim 15, wherein the array of thru-holes includes a first section and a second section, the thru-holes of the first and second sections configured to receive electrical contacts having different first and second cross-sectional profiles, respectively.

18. The electrical connector assembly of claim 12, wherein the receiving cavity is defined by interior sidewalls that generally face the central axis, the dielectric sheet having an outer edge that defines a perimeter of the movable guard, wherein the outer edge interfaces with at least one of the interior sidewalls and slides along the at least one interior sidewall as the movable guard moves to the deeper position.

19. The electrical connector assembly of claim 12, wherein the dielectric sheet comprises a dielectric film, the inner edges being stamped edges.

20. The electrical connector assembly of claim 19, wherein the dielectric film has a thickness between 0.1 millimeter and 0.5 millimeter.

* * * * *